United States Patent [19]

Hirabayashi et al.

[11] Patent Number: 4,882,267

[45] Date of Patent: Nov. 21, 1989

[54] SILVER HALIDE PHOTOGRAPHIC LIGHT-SENSITIVE MATERIAL WITH EXCELLENT COLOR REPRODUCIBILITY

[75] Inventors: Shigeto Hirabayashi; Hirokazu Sato, both of Tokyo, Japan

[73] Assignee: Konica Corporation, Tokyo, Japan

[21] Appl. No.: 127,920

[22] Filed: Dec. 2, 1987

[30] Foreign Application Priority Data

Dec. 2, 1986 [JP] Japan ..... 61-287274

[51] Int. Cl.[4] ..... G03C 7/34; G03C 7/26

[52] U.S. Cl. ..... 430/546; 430/549; 430/551; 430/552; 430/553; 430/505

[58] Field of Search ..... 430/551, 552, 553, 546, 430/549, 372, 505

[56] References Cited

U.S. PATENT DOCUMENTS

| | | | |
|---|---|---|---|
| 4,447,523 | 5/1984 | Ross et al. | 430/505 |
| 4,526,864 | 7/1985 | Takada et al. | 430/551 |
| 4,584,264 | 4/1986 | Ohki et al. | 430/542 |
| 4,623,616 | 11/1986 | Takoda et al. | 430/545 |
| 4,666,826 | 5/1987 | Takada et al. | 430/549 |
| 4,696,893 | 9/1987 | Umemoto et al. | 430/543 |
| 4,731,320 | 3/1988 | Sasaki et al. | 430/505 |

FOREIGN PATENT DOCUMENTS

| | | |
|---|---|---|
| 80896A3 | 6/1983 | European Pat. Off. . |
| 3602649A1 | 7/1986 | Fed. Rep. of Germany . |
| 231664A1 | 1/1986 | German Democratic Rep. . |

OTHER PUBLICATIONS

Patent Abstracts of Japan, vol. 9, No. 72 (P-345) [1795], 4/2/85, and JPA-59-204041, 11/84.

Chemical Abstracts Vol. 68, No. 18, 1968, p. 8003, Abstract #83108U.

*Primary Examiner*—Paul R. Michl

*Assistant Examiner*—Mark R. Buscher

*Attorney, Agent, or Firm*—Jordan B. Bierman

[57] ABSTRACT

A silver halide photographic light-sensitive material having a high color reproducibility is disclosed. The photographic comprises a support having thereon a blue-sensitive silver halide emulsion layer, a green-sensitive silver halide emulsion layer and a red-sensitive silver halide emulsion layer in which the red sensitive emulsion layer contains a non-color-forming compound represented by the following formula [I], a compound represented by the following formula [II] and at least one cyan-forming coupler represented by the following formula [III] or [IV]:

Formula [I]

Formula [II]

Formula [III]

Formula [IV]

The photographic material is improved in spectral aborption, stability and maximum density of the cyan image thereof.

20 Claims, No Drawings

SILVER HALIDE PHOTOGRAPHIC LIGHT-SENSITIVE MATERIAL WITH EXCELLENT COLOR REPRODUCIBILITY

FIELD OF THE INVENTION

The present invention relates to a silver halide photographic light-sensitive material, which excels in color reproducibility as well as image preservability and provides a high maximum density.

BACKGROUND OF THE INVENTION

Among phenol type cyan couplers applied, for example, to a color photographic paper which is subjected to direct appreciation by human vision, the 2,5-diacylamino cyan coupler is well known in the art for its excellence in dark fading property. However the maximum absorption wave length of a dye formed from the above cyan coupler is found on the shorter wave side and the secondary absorption being large in the vicinity of 550 nm. Correspondingly, the dye formed from this reproducing cyan coupler has a disadvantage of not being capable of reproducing green color to a sufficient degree of brightness when compared to dyes formed from those conventional phenol type cyan couplers which do not have an acylamino group in the 5-position.

Furthermore, the phenol type cyan couplers with an alkyl group having more than two carbon atoms in the 5-position are well known among phenol type cyan couplers for having excellent color reproducibility. The dark fading property of a dye formed from such a cyan coupler, however, although better than conventional phenol type cyan couplers with a methyl group in the 5-position, has not yet reached a satisfactory level.

Japanese Patent Examined Publication No. 32727/1973, and Japanese Patent Publications Open to Public Inspection (hereinafter referred to as Japanese Patent O.P.I. Publications) Nos. 13923/1978, 119235/1979, 119921/1979, 119922/1979, 25057/1980, 36869/1980 and 81836/1981, respectively disclose a method of using a phosphoric ester compound as a high boiling organic solvent (HBS) into which a coupler is dissolved and dispersed, as a technique for improving hear/humidity resistance or dark fading property of a dye image formed from couplers.

In other words, additional improvement in image preservability of a cyan dye image formed from such a cyan coupler is possible if phosphoric ester compound is used together with either phenol type cyan coupler with an alkyl group having two or more carbon atoms in the 5-position or the 2,5-diacylamino cyan coupler mentioned above.

Nevertheless, through examination by the inventors, it was found out that the combined use of phosphoric ester compound and 2,5-diacylamino cyan coupler mentioned above, will not only cause the reduction in color density but also shorten the maximum absorption wave length and enhance secondary absorption in the vicinity of 550 nm as was mentioned above.

Furthermore, the secondary absorption is found in the vicinity of 420 nm in case if a dye formed from the 2,5-diacylamino cyan coupler or the phenol type cyan coupler with an alkyl group having more than two carbon atoms in the 5-position. While this secondary absorption is mostly insignificant in the absence of a phosphoric ester compound, the same compound, when employed together with the coupler, has a tendency to enhance the secondary absorption. The tendency is found to be particularly serious in the vicinity of 420 nm of a phenol type cyan coupler with an alkyl group having more than two carbon atoms in the 5-position.

In other words, while the combined use of a phosphoric ester compound and a 2,5-diacylamino cyan couplers enables an additional improvement in dark fading property, at the same time, it not only reduces the color forming property but also transfers the maximum absorption wave length to the short wave side, resulting in a considerable deterioration of color reproduction by reinforcing the large secondary absorption in the vicinity of 550 nm, a disadvantage of this particular coupler.

On the other hand, in case of a phenol type cyan coupler with an alkyl group having more than two carbon atoms in the 5-position, their minor weakness in dark fading property can be corrected by additional use of a phosphoric ester compound. Nevertheless, the use of the compound causes deterioration in color forming property as well as in color reproducibility due to a larger secondary absorption of the dye in the vicinity of 420 nm which otherwise does not occur.

As described so far, there has not been a silver halide photographic light-sensitive material containing a cyan coupler and featuring excellent dark fading, color reproduction as well as spectral absorption properties.

Through further examination as an attempt to fulfill the above-mentioned properties, the inventors have succeeded in obtaining a cyan dye image with adequate dark fading, color forming and spectral absorption properties, which consequently led to the present invention. The discovery of that particular cyan dye image has been made possible by emplying a specific phosphoric ester compound as well as a specific non-color forming compound together with at least a single cyan coupler selected out of a particular set of 2,5-diacyl cyan couplers or that of phenol series cyan couplers with an alkyl group having more than two carbon atoms in the 5-position.

SUMMARY OF THE INVENTION

Therefore, the first object of the invention is to provide a silver halide photographic light-sensitive material, of which cyan dye image has the maximum absorption wave length located sufficiently within the long wave side of the red spectral range as well as smaller secondary absorption around 420 nm and 550 nm, and, accordingly features excellent color reproduction.

The second object of the invention is to provide a silver halide photographic light-sensitive material with a superior cyan dye image preservability.

The third object of the invention is to provide a silver halide photographic light-sensitive material capable of obtaining high density color image with an adequately high maximum density value.

The above-listed purposes can be attained by a silver halide photographic light-sensitive material compresing a support having thereon a blue-sensitive silver halide emulsion layer, a green-sensitive silver halide emulsion layer and a red-sensitive silver halide emulsion layer in which said red-sensitive silver halide emulsion layer contains a non-colorforming compound represented by the following formula [I], a compound represented by the following formula [II] and at least one cyan coupler represented by the following formula [III] or [IV]:

$$R_1—NHSO_2—R_2 \qquad \text{Formula[I]}$$

wherein $R_1$ and $R_2$ are a hydrogen atom, an alkyl group, a cycloalkyl group, an alkenyl group, a cycloalkenyl group, an alkynyl group, an aryl group, a heterocyclic group, an alkoxy group, an aryloxy group, a heterocyclic-oxy group or

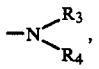

respectively, wherein $R_3$ and $R_4$ are a hydrogen atom, an a group or an aryl group, respectively, and $R_1$ and $R_2$ may be the same or different from each other, and the each group represented by $R_1$ through $R_4$ is allowed to have a substituent,

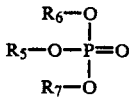

Formula [II]

wherein $R_5$, $R_6$ and $R_7$ are an alkyl group, a cycloalkyl group or an aryl group, and they may be the same or different each other, and the each group represented by $R_6$ through $R_7$ is allowed to have a substituent,

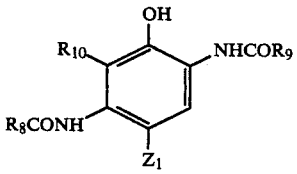

Formula [III]

wherein $R_8$ is an alkyl group or an aryl group; $R_9$ is an alkyl group, a cycloalkyl group, an aryl group or a heterocyclic group; $R_{10}$ is a hydrogen atom, a halogen atom an alkyl group or an alkoxy group, and $R_{10}$ is allowed to bond with $R_8$ to form a ring; $Z_1$ is a hydrogen atom or a group capable of being released upon reaction with the oxidized product of an aromatic primary amine color developing agent; and the each group represented by $R_8$ through $R_{10}$ is allowed to have a substituent;

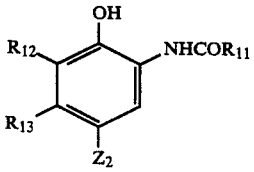

Formula [IV]

wherein $R_{11}$ is a ballast group: $R_{12}$ is a hydrogen atom, a halogen atom or an alkyl group; $R_{13}$ is an alkyl group having two to six carbon atoms; $Z_2$ is a hydrogen atom or a group capable of being released upon reaction with the oxidized product of an aromatic primary amine color developing agent; and the each group represented by $R_{11}$ through $R_{13}$ is allowed to have a substituent.

DETAILED DESCRIPTION OF THE INVENTION

The non-color forming compound expressed by Formula [I] above, hereinafter referred to as "the non-color forming compound of the invention", is hereinunder described.

The examples of an alkyl group expressed either by $R_1$ or $R_2$ in Formula [I] include those with 1 to 32 carbon atoms, an alkenyl group or alkynyl group with 2 to 32 carbon atoms, a cycloalkyl group or cycloalkenyl group with 3 to 12 carbon atoms. The alkyl group, alkenyl group and alkynyl group may be either straight-chained or branched and may have a substituent.

A phenyl group is preferable as the aryl group represented by $R_1$ or $R_2$, and the phenyl group may have a substituent.

A 5–7 membered ring, which may be condensed and may have a substituent, is preferred as the heterocycle group represented by $R_1$ or $R_2$.

A 2-ethoxyethoxy group, a pentadecyloxy group, a 2-dodecyloxyethoxy group, a phenethyloxyethoxy, etc., which may have a substituent, are examples of groups preferred as the alkoxy group represented by $R_1$ or $R_2$.

Furthermore, a phenyloxy group is preferred as the aryloxy group represented by $R_1$ or $R_2$, wherein an aryl nucleus may have a substituent. The examples of such a phenoxy group include a phenoxy group, p-t-butylphenoxy group, m-pentadecylphenoxy group, etc.

As the heterocyclic oxy group represented by $R_1$ or $R_2$, those having a 5–7 membered teterocycle is preferred. The heterocycle may have a substituent. The examples of such a heterocyclic oxy group include a 3,4,5,6-tetrahydropyranyl-2-oxy group, 1-phenyltetrazole-5-oxy group, etc.

In addition, the preferred examples of an alkylamino group or arylamino group represented by $R_1$ or $R_2$, more specifically by

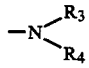

include a diethylamino group, anilino group, p-chloranilino group, dodecylamino group, 2-methyl-4-cyanoanilino group, etc., each of which may have a substituent.

A particularly advantageous non-color forming compound of the invention is the compound expressed by the following Formula [I-A].

$$R'_1—NHSO_2—R'_2 \qquad \text{Formula [I-A]}$$

$R'_1$ and $R'_2$ in the above formula respectively represent either an alkyl group or aryl group, each of which may have a substituent. A preferred condition is where at least one of $R'_1$ and $R'_2$ is an aryl group. Especially preferable is that both $R'_1$ and $R'_2$ are of an aryl group, in particular, a phenyl group. Furthermore, if $R'_1$ is a phenyl group, it is particularly desirable for the substituent group in the para-position of sulfonamide to have a Hammett $\delta p$ value of greater than $-0.4$.

A definition of the alkyl group or aryl group represented by $R'_1$ or $R'_2$, is similar to that of the alkyl group of aryl group represented by $R_1$ or $R_2$ in Formula [I].

The non-color forming compound of the invention may form in $R_1$ or $R_2$ a polymer which is larger than a dimer. $R_1$ and $R_2$ may mutually combine to form a 5–6 membered ring.

Moreover, it is preferable for the non-color forming compound of the invention to have a total of no less than 8, especially than 12 in particular, carbon atoms.

Below are representative examples of the non-color forming compound of the present invention.
| Compound No. | $R_1$—$NHSO_2$—$R_2$ | |
|---|---|---|
| | $R_1$ | $R_2$ |
| A-1 | 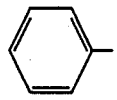 | 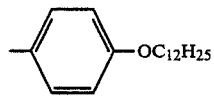 |
| A-2 | 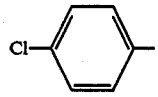 | 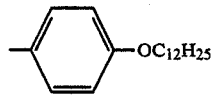 |
| A-3 | 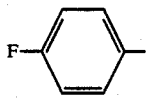 | 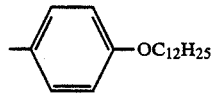 |
| A-4 | 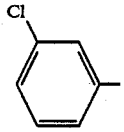 | 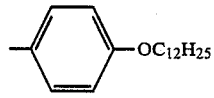 |
| A-5 | 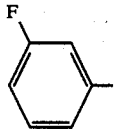 | 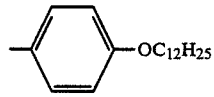 |
| A-6 | 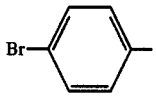 | 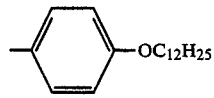 |
| A-7 | 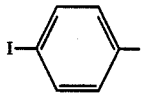 | 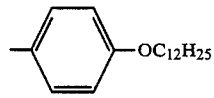 |
| A-8 | 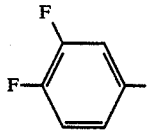 | 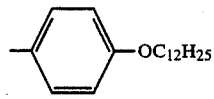 |
| A-9 | 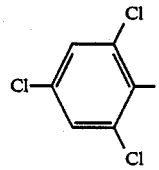 | 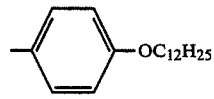 |
| A-10 | 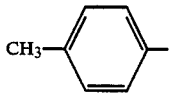 | 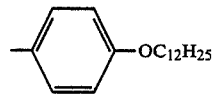 |
| A-11 | 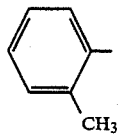 | 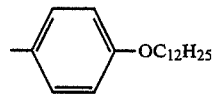 |

-continued
$R_1—NHSO_2—R_2$
| Compound No. | $R_1$ | $R_2$ |
|---|---|---|
| A-12 | 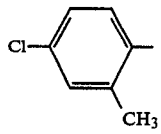 | 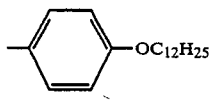 |
| A-13 | 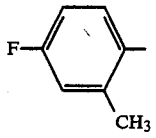 | 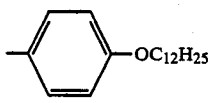 |
| A-14 | 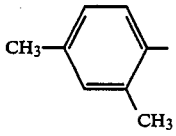 | 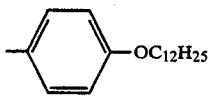 |
| A-15 | 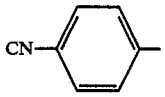 | 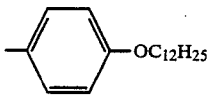 |
| A-16 | 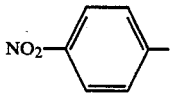 | 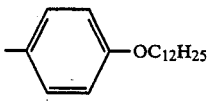 |
| A-17 | 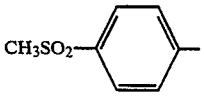 | 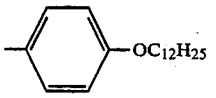 |
| A-18 | 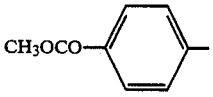 | 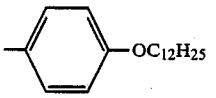 |
| A-19 | 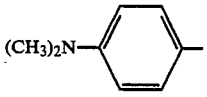 | 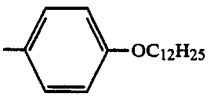 |
| A-20 | 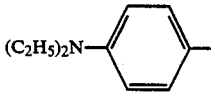 | 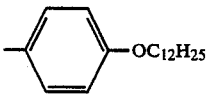 |
| A-21 | 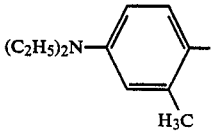 | 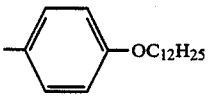 |
| A-22 | 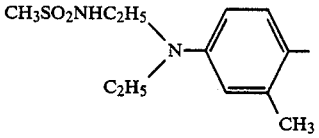 | 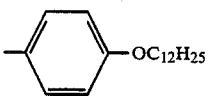 |

-continued
$R_1—NHSO_2—R_2$
| Compound No. | $R_1$ | $R_2$ |
|---|---|---|
| A-23 | 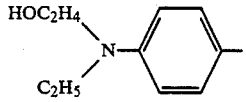 | 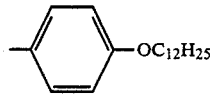 |
| A-24 | 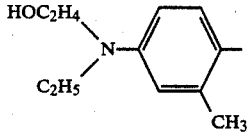 | 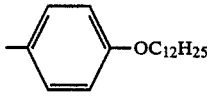 |
| A-25 | 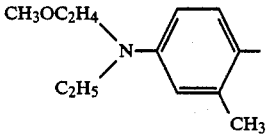 | 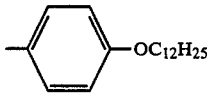 |
| A-26 | 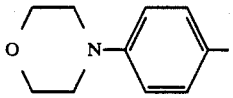 | 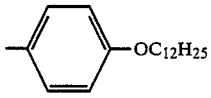 |
| A-27 | 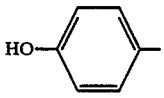 | 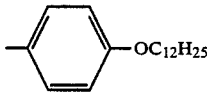 |
| A-28 | 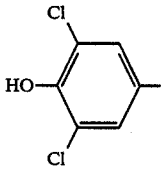 | 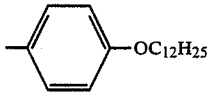 |
| A-29 | 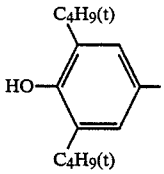 | 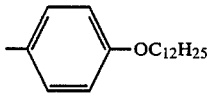 |
| A-30 | 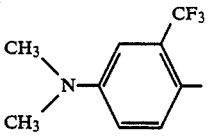 | 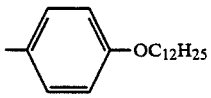 |
| A-31 | 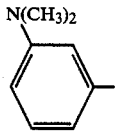 | 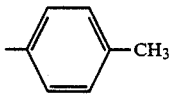 |
| A-32 | 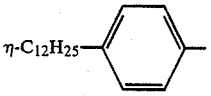 | 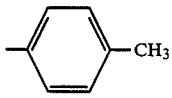 |
| A-33 | 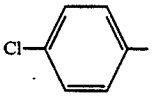 | 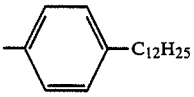 |

-continued
$R_1—NHSO_2—R_2$
| Compound No. | $R_1$ | $R_2$ |
|---|---|---|
| A-34 | 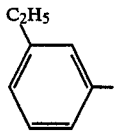 | 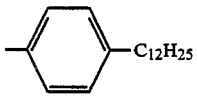 |
| A-35 | 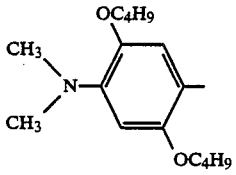 | 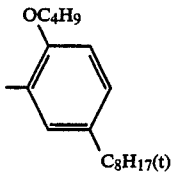 |
| A-36 | 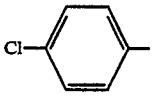 | 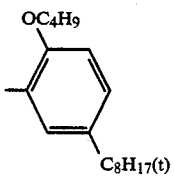 |
| A-37 | 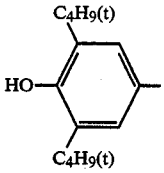 | 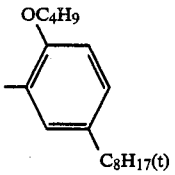 |
| A-38 | 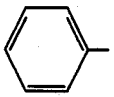 | 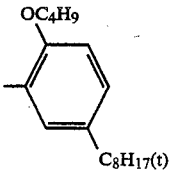 |
| A-39 | 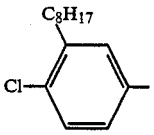 | 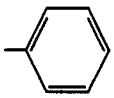 |
| A-40 | 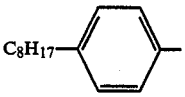 | 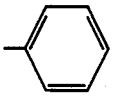 |
| A-41 | 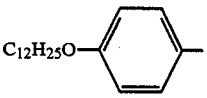 | 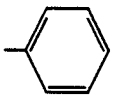 |
| A-42 | 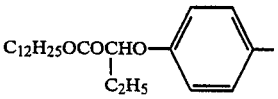 | 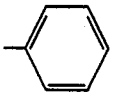 |
| A-43 | 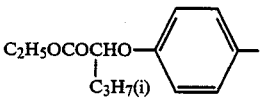 | 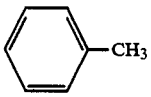 |

-continued
| Compound No. | $R_1$—NHSO$_2$—$R_2$ $R_1$ | $R_2$ |
|---|---|---|
| A-44 | 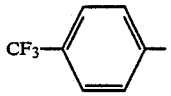 | 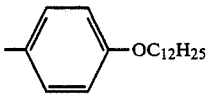 |
| A-45 | 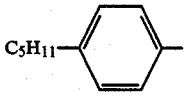 | 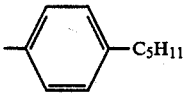 |
| A-46 | 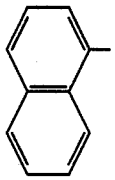 | 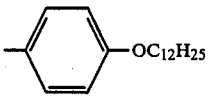 |
| A-47 | 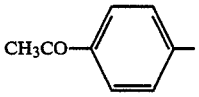 | 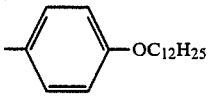 |
| A-48 | 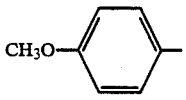 | 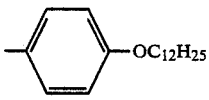 |
| A-49 | 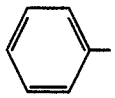 | $-C_{16}H_{33}$ |
| A-50 | 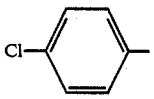 | $-C_{16}H_{33}$ |
| A-51 | 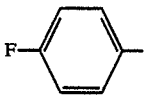 | $-C_{16}H_{33}$ |
| A-52 | 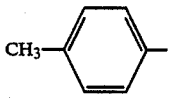 | $-C_{16}H_{33}$ |
| A-53 | 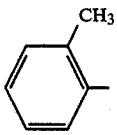 | $-C_{16}H_{33}$ |
| A-54 | 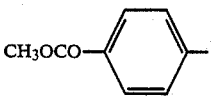 | $-C_{16}H_{33}$ |
| A-55 | 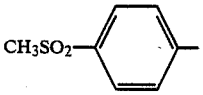 | $-C_8H_{17}$ |

-continued
| Compound No. | $R_1$—$NHSO_2$—$R_2$ | |
|---|---|---|
| | $R_1$ | $R_2$ |
| A-56 | 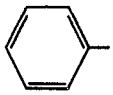 | 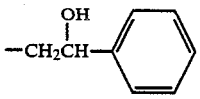 |
| A-57 | 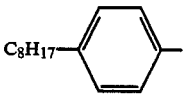 | $-C_3H_7(i)$ |
| A-58 | $C_8H_{17}-$ | 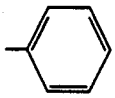 |
| A-59 | $C_4H_9CH(C_2H_5)CH_2-$ | 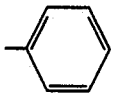 |
| A-60 | $CH_3-$ | 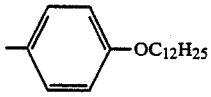 |
| A-61 | $Cl(CH_2)_2-$ | 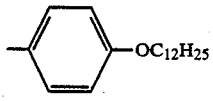 |
| A-62 | $CF_3CH_2-$ | 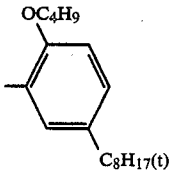 |
| A-63 | 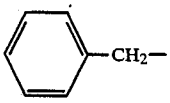 | 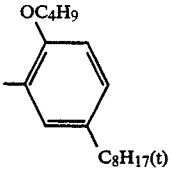 |
| A-64 | $C_8H_{17}-$ | 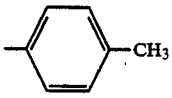 |
| A-65 | $C_{12}H_{25}-$ | 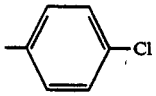 |
| A-66 | 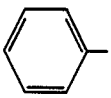 | $-N(CH_3)_2$ |
| A-67 | 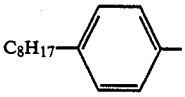 | $-N(CH_3)_2$ |

-continued
| Compound No. | $R_1$—$NHSO_2$—$R_2$ | |
|---|---|---|
| | $R_1$ | $R_2$ |
| A-68 | 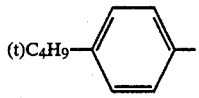 | 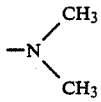 |
| A-69 | 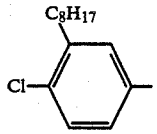 | 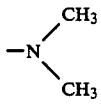 |
| A-70 | 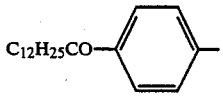 | 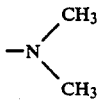 |
| A-71 | 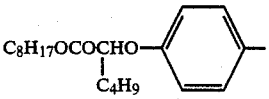 | 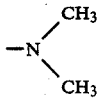 |
| A-72 | 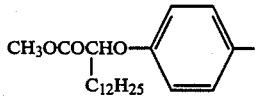 | 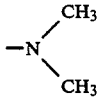 |
| A-73 | 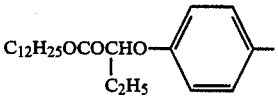 | 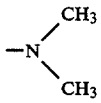 |
| A-74 | 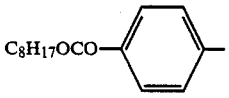 | 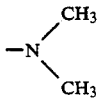 |
| A-75 | 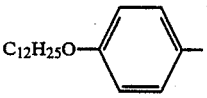 | 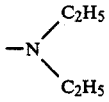 |
| A-76 | 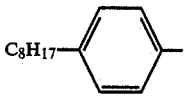 | 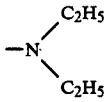 |
| A-77 | 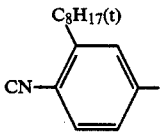 | 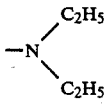 |
| A-78 | 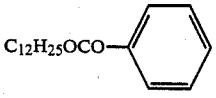 | 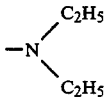 |
| A-79 | 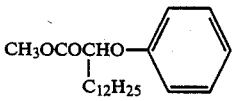 | 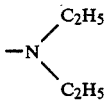 |

-continued

| Compound No. | $R_1$—$NHSO_2$—$R_2$ | |
|---|---|---|
| | $R_1$ | $R_2$ |
| A-80 | $CH_3OCOCHO$—<br>\|<br>$C_3H_7(i)$ | $-N(C_2H_5)_2$ |
| A-81 | $C_{12}H_{25}OCOCH_2$— | $-N(C_2H_5)_2$ |
| A-82 | $C_{12}H_{25}OCOCHOCO$—<br>\|<br>$C_2H_5$ | $-N(C_2H_5)_2$ |
| A-83 | $C_{12}H_{25}OCO(CH_2)_3O$— | $-N(CH_3)_2$ |
| A-84 | $C_{10}H_{21}NHCO$— | $-N(CH_3)_2$ |
| A-85 | $C_8H_{17}$— | $-N(C_2H_5)_2$ |
| A-86 | $C_8H_{17}$— | —NH— |
| A-87 | $C_8H_{17}$— | $-C(CH_3)_3$ |
| A-88 | $CCl_3CH_2$— | $-C_{16}H_{33}$ |
| A-89 | $C_5H_{11}$— | $-N(C_3H_7)_2$ |
| A-90 | H— | —$OC_{12}H_{25}$ |
| A-91 | H | $OC_4H_9$<br>(t)$C_8H_{17}$ |
| A-92 | $CF_3CH{=}CH$— | —$C_{12}H_{25}$ |
| A-93 | | —$C_8H_{17}$(t) |

-continued
| Compound No. | $R_1$—$NHSO_2$—$R_2$ | |
|---|---|---|
| | $R_1$ | $R_2$ |
| A-94 | $HOCH_2CH_2C{\equiv}C$— | 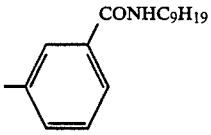 |
| A-95 | 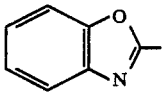 | $-C_{18}H_{37}$ |
| A-96 | 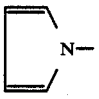 | 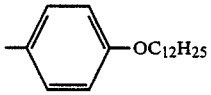 |
| A-97 | $C_4H_9CO$— | 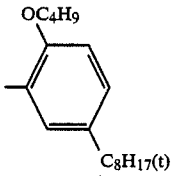 |
| A-98 | $C_{10}H_{21}NHCO$— | 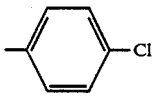 |
| A-99 | 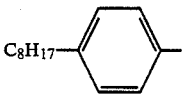 | $-OC_2H_5$ |
| A-100 | 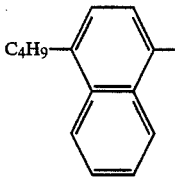 | 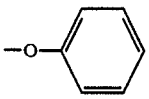 |
| A-101 | 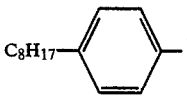 | 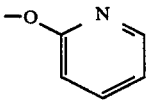 |
| A-102 | 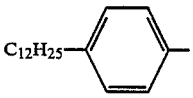 | $-NH_2$ |
| A-103 | 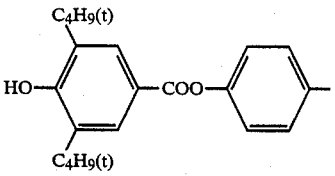 | 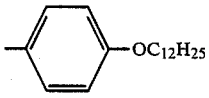 |

-continued
$R_1—NHSO_2—R_2$
| Compound No. | $R_1$ | $R_2$ |
|---|---|---|
| A-104 | 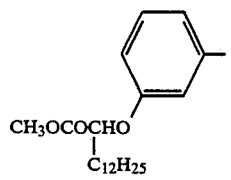 | 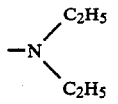 |
| A-105 | 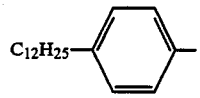 | 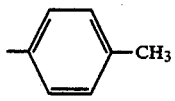 |
| A-106 | 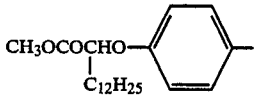 | 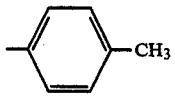 |
| A-107 | 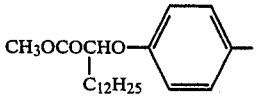 | 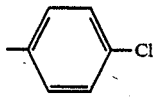 |
| A-108 | 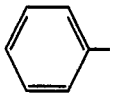 | 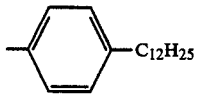 |
| A-109 | 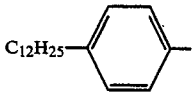 | 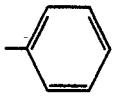 |
| A-110 | 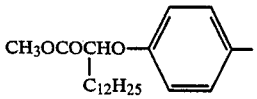 | 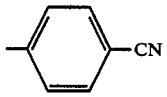 |
| A-111 | 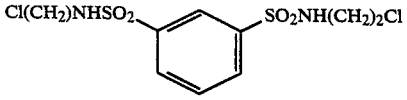 | |
| A-112 | 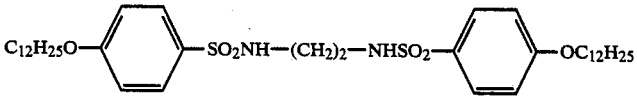 | |
| A-113 | 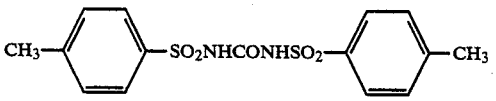 | |
| A-114 | 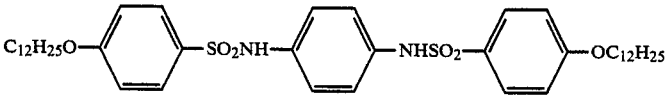 | |
| A-115 | 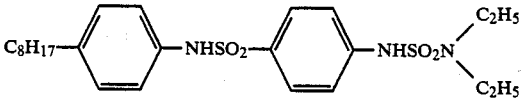 | |

-continued

| Compound No. | $R_1$—$NHSO_2$—$R_2$ | |
|---|---|---|
| | $R_1$ | $R_2$ |
| A-116 | 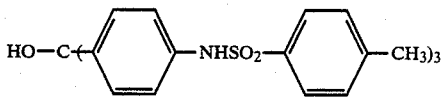 | |
| A-117 | 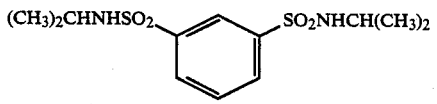 | |
| A-118 | 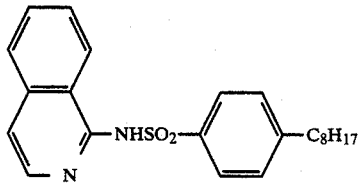 | |
| A-119 | 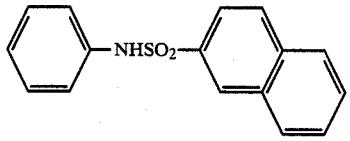 | |
| A-120 | 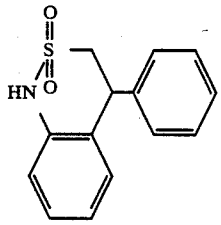 | |

The compound of the invention can be synthesized by means of conventionally known methods such as those disclosed in Japanese Patent Application No. 20589/1986, etc.

A total amount of non-color forming compound to be used in the invention is preferably 5–500 mol %, in particular 10–300 mol % per total amount of a cyan coupler expressed by either Formula [III] or [IV] above.

Some examples of the non-color forming compound of the invention are described in Japanese O.P.I. Publications Nos. 76543/1982, 179842/1982 and 1139/1983, as well as in Japanese Patent Application No. 20589/1986.

However, the above-mentioned documents are short of providing any information on the non-color forming compound of the invention which is capable of improving color reproducibility by shifting the maximum absorption wave length of a cyan dye to the long wave side.

Through their devoted research, the inventors have discovered that a non-color forming compound of the invention improves the color forming property of a cyan dye image which is obtained from a cyan coupler indicated either in Formula [III] or [IV] above and shifts the maximum absorption wave length to the long wave side while reducing the secondary absorption in the vicinity of 420 nm and 550 nm, which consequently has resulted in a significant improvement in color reproducibility. Such effects were realized, for the first time, by the present invention.

It is conjectured that such effects mentioned above are made possible as a result of an increase in proton donation of the —$NHSO_2$— portion of the non-color forming compound, enabling —$NHSO_2$— to combine, by forming a hydrogen bond, with the cyan dye formed from a cyan coupler which is expressed either by Formula [III] or [IV]. This, in turn, influences the absorption wave length of the cyan dye, shifting it to the long wave length side.

The compound expressed by Formula [II] is hereinunder described.

The compound expressed by Formula [II] above is an organic solvent with a high boiling point (hereinafter referred to as "the high boiling organic solvent of the invention").

$R_5$, $R_6$ and $R_7$ in Formula [II] respectively represent an alkyl group, cycloalkyl group or aryl group.

A preferable alkyl group in this case is either straight-chained or branched, with 1–32 carbon atoms, and may have a substituent. The example of such an alkyl group include a straight-chained or branched butyl group, hexyl group, octyl group. dodecyl group, octadecyl group, etc. Especially preferable alkyl groups are those with 4–18 carbon atoms, in particular, 6–12 carbon atoms.

The examples of the cycloalkyl group represented by $R_5$, $R_6$ or $R_7$ include a cyclopentyl group, cyclohexyl group, cycloheptyl group, etc., where a cyclohexyl group being particularly preferable. Each of these groups may have a substituent.

The examples of the aryl group represented by $R_5$, $R_6$ or $R_7$ include a phenyl group, naphthyl group, etc. Each of which may have a substituent. Additionally specific examples of such an aryl group are a phenyl group, p-cresyl group, m-cresyl group, o-cresyl group, p-chlorphenyl group, p-t-butyl-phenyl group, etc.

Those with a dielectric consonant of more than 3.5, within the range of 4.0–8.5 in particular, are preferred as a high boiling organic solvent of the invention.

The specific examples of high boiling organic solvent of the present invention are listed below.

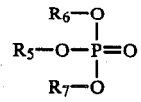

| NO. | $R_5$ | $R_6$ | $R_7$ |
|---|---|---|---|
| II-1 | $-C_6H_{13}(n)$ | $-C_6H_{13}(n)$ | $-C_6H_{13}(n)$ |
| II-2 | $-C_8H_{17}(n)$ | $-C_8H_{17}(n)$ | $-C_8H_{17}(n)$ |
| II-3 | $-C_{12}H_{25}(n)$ | $-C_{12}H_{25}(n)$ | $-C_{12}H_{25}(n)$ |
| II-4 | 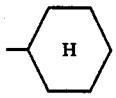 | 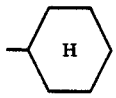 | 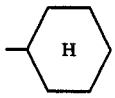 |
| II-5 | 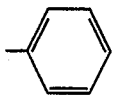 | 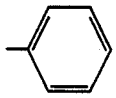 | 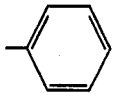 |
| II-6 | 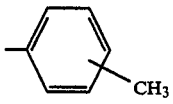 | 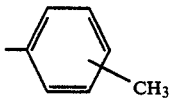 | 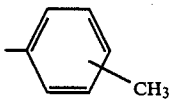 |
| II-7 | $-CH_2CH(CH_2)_3CH_3$ \| $CH_2CH_3$ | $-CH_2CH(CH_2)_3CH_3$ \| $CH_2CH_3$ | $-CH_2CH(CH_2)_3CH_3$ \| $CH_2CH_3$ |
| II-8 | $-C_4H_9(n)$ | $-C_8H_{17}(n)$ | $-C_8H_{17}(n)$ |
| II-9 | 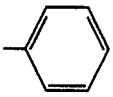 | 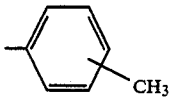 | 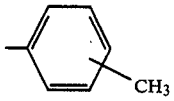 |
| II-10 | 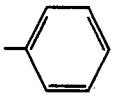 | 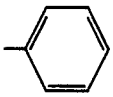 | 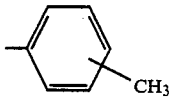 |
| II-11 | 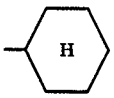 | 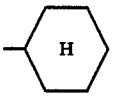 | 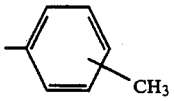 |
| II-12 | 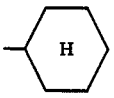 | $-C_8H_{17}(n)$ | $-C_8H_{17}(n)$ |
| II-13 | 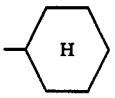 | $-C_6H_{13}(n)$ | $-C_6H_{13}(n)$ |
| II-14 | 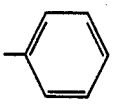 | 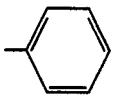 | $-CH_2CHC_4H_9$ \| $C_2H_5$ |
| II-15 | $-C_8H_{17}(n)$ | $-C_8H_{17}(n)$ | $-CH_2CH_2OCH_2CH_3$ |

-continued

| NO. | $R_5$ | $R_6$ | $R_7$ |
|---|---|---|---|
| II-16 | 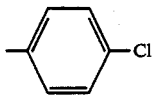 | 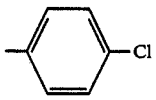 | 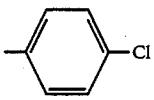 |
| II-17 | $-CH_2CH_2C(CH_3)_3$ | $-CH_2CH_2C(CH_3)_3$ | $-CH_2CH_2C(CH_3)_3$ |
| II-18 | 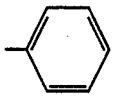 | 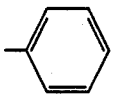 | 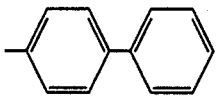 |
| II-19 | 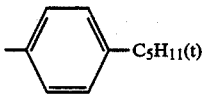 | 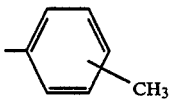 | 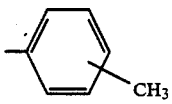 |
| II-20 | $-CHC_5H_{11}(n)$ \| $CH_3$ | $-CHC_5H_{11}(n)$ \| $CH_3$ | $-CHC_5H_{11}(n)$ \| $CH_3$ |
| II-21 | 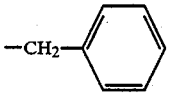 | 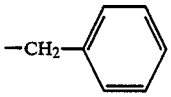 | 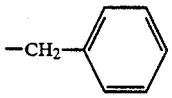 |

The examples of high boiling organic solvent of the present invention includes the phosphoric ester compounds presented in Japanese Patent Examined Publications Nos. 32727/1973, 13923/1978, 119235/1979, 119921/1979, 119922/1984, 25057/1980, 36869/1980, 81836/1981, etc. and the solvent can be synthesized by conventionally known methods, such as, those disclosed in the above documents.

The high boiling organic solvent of the present invention can be employed as a solvent to dissolve or disperse the hydrophobic compounds, such as, the cyan coupler represented by Formula [III] or [IV], when adding the compounds to the red-sensitive silver halide emulsion layer of the silver halide photographic light-sensitive material of the present invention.

While the amount of the high boiling organic solvent of the present invention to be employed is not particularly specified, its preferable range is 10 to 500 g per 100 g of the cyan coupler represented by Formula [III] or [IV].

When dissolving or diffusing a cyan coupler represented by Formula [III] or [IV] into the high boiling organic solvent of the present invention, the solvent may be employed alone, or together with another high boiling organic solvent or even with a low boiling organic solvent if necessary.

The high boiling organic solvent of the present invention, when used together with the cyan coupler expressed by Formula [III] or [IV], is effective for improving the image preservability of the cyan dye image formed from such a cyan coupler.

The silver halide photographic light-sensitive material of the present invention includes at least one kind of the cyan coupler expressed by Formula [III] or [IV]. "The cyan couplers of the invention" is a general term employed hereinafter to denote the cyan couplers of both the above-mentioned Formulae.

The alkyl group in a cyan coupler represented by $R_8$ in Formula [III] is favorably either a straight-chained or branched group having 1 to 32 carbon atoms, and may have a substituent.

The preferred aryl group represented by $R_8$ is a phenyl group, which may have a substituent.

The preferred alkyl group represented by $R_9$ in Formula [III] is either a straight-chained or branched group having 1 to 32 carbon atoms, and may have a substituent.

The preferred cycloalkyl group represented by $R_9$ is a group having 1 to 32 carbon atoms and may have a substituent.

The preferred aryl group represented by $R_9$ is a phenyl group, which may have a substituent.

The preferred heterocyclic group represented by $R_9$ is a 5–7 membered group, which may have a substituent or be condensed.

While $R_{10}$ represents a hydrogen atom, halogen atom, alkyl group or alkoxy group, the hydrogen atom is particularly preferred.

Moreover, the preferred ring formed by a combination between $R_8$ and $R_{10}$ is a 5–6 membered ring. The examples of such a ring include

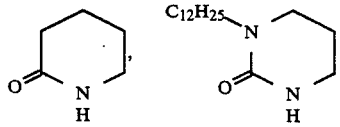

Examples of those groups represented by $Z_1$ in Formula [III], which is capable of splitting off in the course of reaction with an oxidized product of a color developing agent include a halogen atom, alkoxy group, aryloxy group, acyloxy group, sulfonyloxy group, acylamino group, sulfonylamino group, alkoxycarbonyloxy group, alkoxycarbonyloxy group, arloxycarbonyloxy group and imide group, among which a halogen atom, aryloxy group and alkoxy group are particularly preferable.

The particularly preferred among the cyan couplers represented by Formula [III] are those which are expressed by Formula [III-A] below.

Formula [III-A]

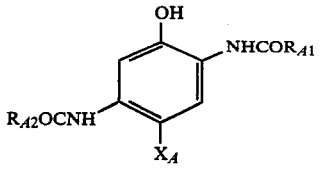

$R_A$ in the above formula represents a phenyl group which is substituted with at least one halogen atom. Such a phenyl group may have a substituent other than a halogen atom. $R_{2A}$ is identical to $R_8$ in Formula [III]. $X_A$ represents a halogen atom, aryloxy group or alkoxy group.

Some of the representative cyan couplers expressed by General Formula [III] are listed below.

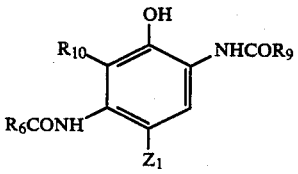

| Example compound No. | $R_9$ | $R_8$ | $R_{10}$ | $Z_1$ |
|---|---|---|---|---|
| C-1 | $-(CF_2)_4H$ | 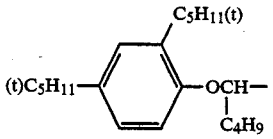 | H | Cl |
| C-2 | 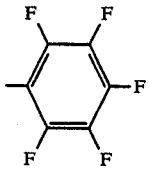 | 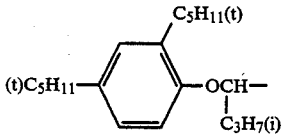 | H | —Cl |
| C-3 | 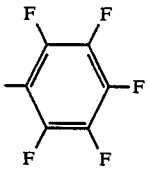 | 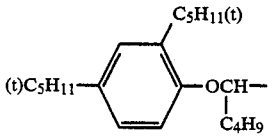 | H | —Cl |
| C-4 | 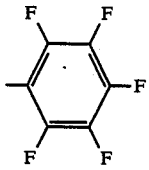 | $C_{16}H_{33}$— | —Cl | —Cl |
| C-5 | 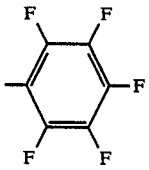 | 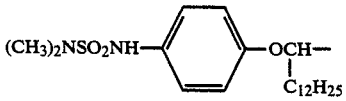 | H | 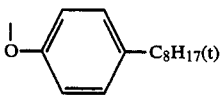 |
| C-6 | 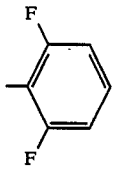 | 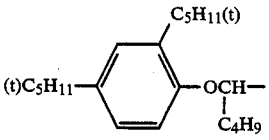 | H | H |

-continued
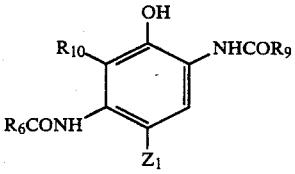
| Example compound No. | $R_9$ | $R_8$ | $R_{10}$ | $Z_1$ |
|---|---|---|---|---|
| C-7 | 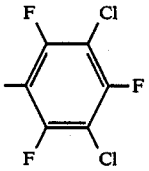 | 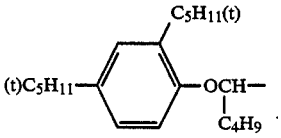 | H | —Cl |
| C-8 | 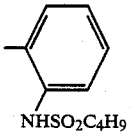 | 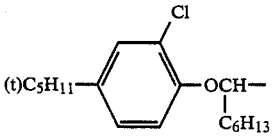 | H | —Cl |
| C-9 | 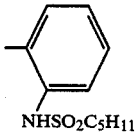 | 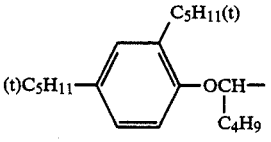 | H | 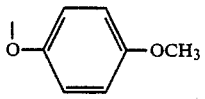 |
| C-10 | 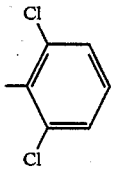 | 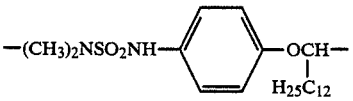 | H | —Cl |
| C-11 | 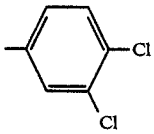 | 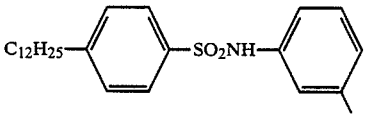 | H | —Cl |
| C-12 | 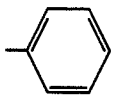 | 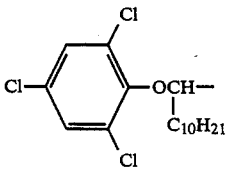 | H | $-OCH_2CONHC_3H_7$ |
| C-13 | 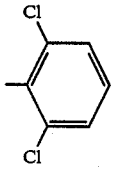 | 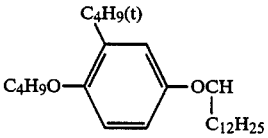 | H | —Cl |
| C-14 | 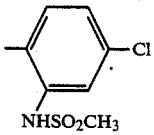 | 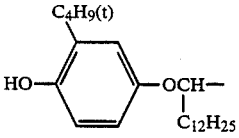 | H | —Cl |

-continued
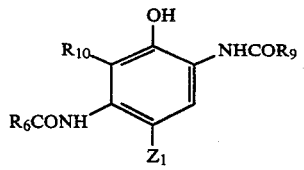
| Example compound No. | $R_9$ | $R_8$ | $R_{10}$ | $Z_1$ |
|---|---|---|---|---|
| C-15 | 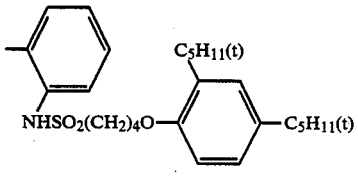 | 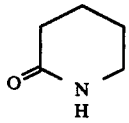 | | —Cl |
| C-16 | 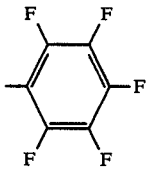 | 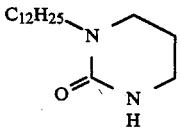 | | —Cl |
| C-17 | 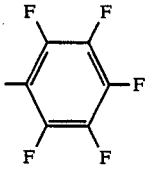 | 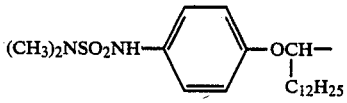 | H | —Cl |
| C-18 | 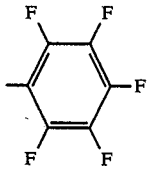 | 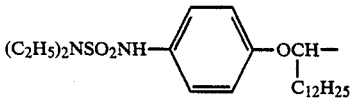 | H | —Cl |
| C-19 | 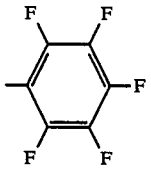 | 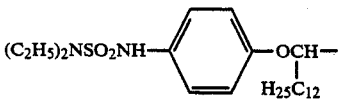 | H | 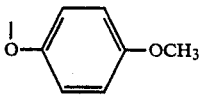 |
| C-20 | 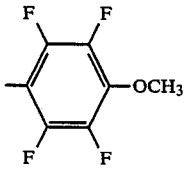 | 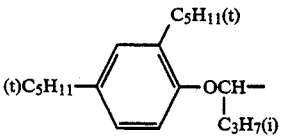 | H | —Cl |
| C-21 | 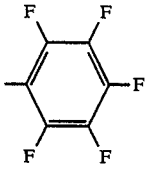 | 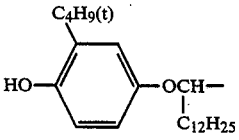 | H | —Cl |

-continued

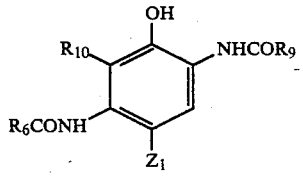

| Example compound No. | $R_9$ | $R_8$ | $R_{10}$ | $Z_1$ |
|---|---|---|---|---|
| C-22 | 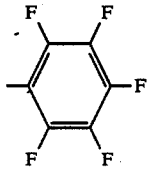 | 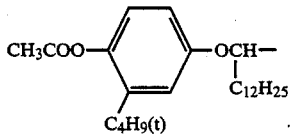 | H | —Cl |
| C-23 | 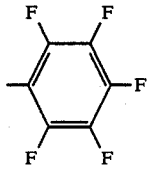 | 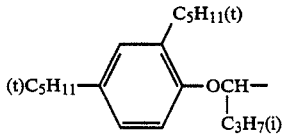 | H | 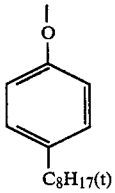 |
| C-24 | 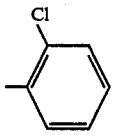 | 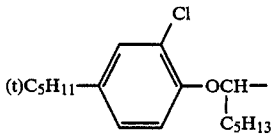 | H | —Cl |
| C-25 | 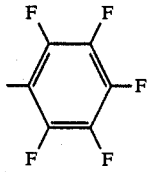 | 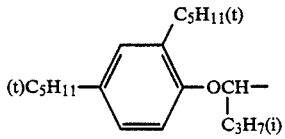 | H | $OCH_2CONHCH_2CH_2OCH_3$ |

The examples of cyan coupler represented by Formula [III] include 2,5-diacylamino cyan couplers listed in Japanese Patent Application No. 21853/1986, pp. 26 to 35; Japanese Patent O.P.I. Publication No. 225155/1985, from the left bottom column of page 7 to the right bottom column of p. 10; Japanese Patent O.P.I. Publication No. 222853/1985, from the left top column of p. 6 to the right bottom column of p. 8; and Japanese Patent O.P.I. Publication No. 185335/1984, from the left bottom column of p. 6 to the left top column of p. 9. It is possible to synthesize the cyan coupler in accordance with the methods disclosed in the above documents.

The ballast group, represented by $R_{11}$ in the cyan coupler of Formula [IV] of the invention, is an organic group having a size and form sufficient for giving enough volume to the coupler molecule to prevent the coupler from diffusing into layers other than its proper designation. A representative ballast group is an alkyl group or aryl group having a total of 8–32 carbon atoms. Such an alkyl group or aryl group may have a substituent. Example substituents for the alkyl group include an alkyl group, aryl group, alkoxy group, aryloxy group, carboxy group, acyl group, ester group, hydroxy group, cyano group, nitro group, carbamoyl group, carbamoyl group, carbonamido group, alkylthio group, arylthio group, sulfonyl group, sulfonamido group, sulfamoyl group, halogen atom, etc. The list of substituents for the alkyl group is almost identical to that of the above aryl group, except for an alkyl group.

Below is a Formula representing a preferred ballast group.

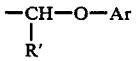

R' represents an alkyl group with 1 to 12 carbon atoms, and Ar represents an aryl group such as a phenol group. The aryl group may have a substituent. Possible substituents for the aryl group are an alkyl group, hydroxy group, alkylsufonamido group, etc., while particularly preferred is a branched alkyl group such as a t-butyl group.

The preferred chloride is a halogen atom represented by $R_{12}$ in Formula [IV] is a chlorine atom.

The examples of alkyl group represented by $R_{12}$ include a methyl group, ethyl group, i-propyl group, etc.

The examples of alkyl group having 2 to 6 carbon atoms, represented by $R_{13}$ in Formula [IV], include an ethyl group, propyl group, butyl group, etc., each of which may be straight-chained or branched.

The examples of a group which can split off in the course or reaction with an oxidized product of an aromatic primary amine color developing agent include a halogen atom such as a fluoring atom and chlorine atom; an aryloxy group, substituted or unsubstituted alkoxy group, acyloxy group, sulfonamido group, arylthio group, heteroylthio group, heteroyloxy group, sulfonyloxy group, carbamoyloxy group, etc.

Specific examples of cyan couplers presented by Formula [IV] are listed below.

General Formula [IV]

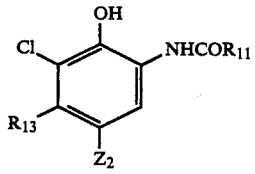

| Coupler No. | $R_{13}$ | $Z_2$ | $R_{11}$ |
|---|---|---|---|
| C-26 | $-C_2H_5$ | $-Cl$ | 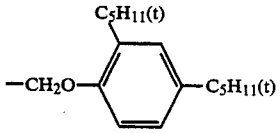 |
| C-27 | $-C_2H_5$ | 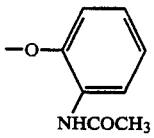 | 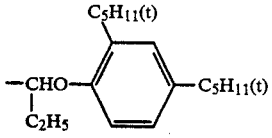 |
| C-28 | 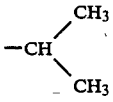 | $-Cl$ | 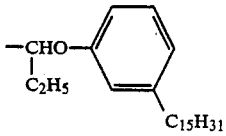 |
| C-29 | $-C_2H_5$ | $-Cl$ | 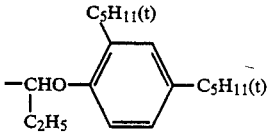 |
| C-30 | $-C_2H_5$ | $-Cl$ | 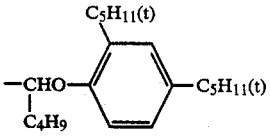 |
| C-31 | $-C_4H_9$ | $-F$ | 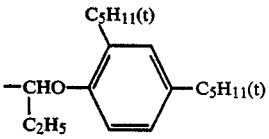 |
| C-32 | $-C_2H_5$ | $-F$ | 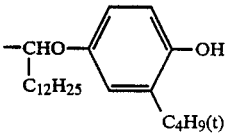 |
| C-33 | $-C_2H_5$ | $-Cl$ | 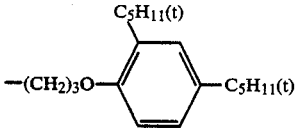 |

-continued
General Formula [IV]
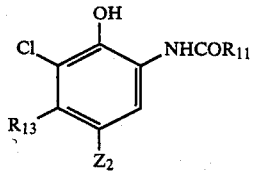
| Coupler No. | $R_{13}$ | $Z_2$ | $R_{11}$ |
|---|---|---|---|
| C-34 | $-C_2H_5$ | $-F$ | 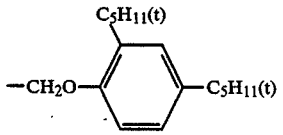 |
| C-35 | 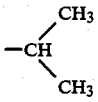 | $-Cl$ | 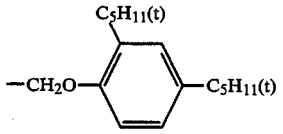 |
| C-36 | $-C_2H_5$ | $-Cl$ | 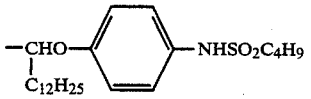 |
| C-37 | $-C_2H_5$ | $-Cl$ | 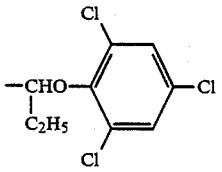 |
| C-38 | $-CH(CH_3)_2$ | $-Cl$ | $-C_{18}H_{37}$ |
| C-39 | $-C_2H_5$ | $-F$ | 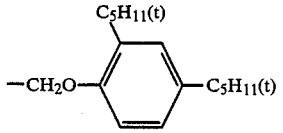 |
| C-40 | $-C_6H_{13}$ | $-Cl$ | 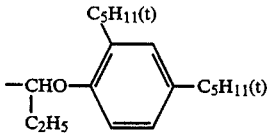 |
| C-41 | $-C_2H_5$ | $-Cl$ | 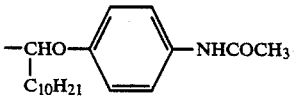 |
| C-42 | $-C_3H_7$ | $-Cl$ | 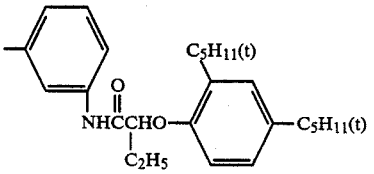 |
| C-43 | $-C_3H_7$ | $-Cl$ | 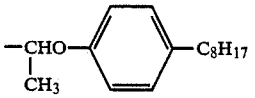 |

-continued
General Formula [IV]
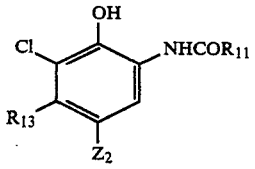
| Coupler No. | $R_{13}$ | $Z_2$ | $R_{11}$ |
|---|---|---|---|
| C-44 | $-C_2H_4NHC(=O)CH_3$ | $-Cl$ | 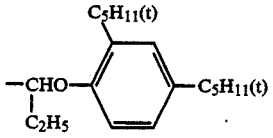 |
| C-45 | $-C_3H_5OCH_3$ | $-Cl$ | 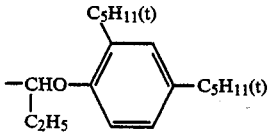 |
| C-46 | $-C_2H_5$ | $-Cl$ | 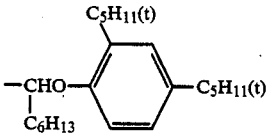 |
| C-47 | $-C_2H_5$ | $-Cl$ | 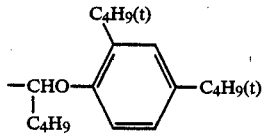 |
| C-48 | $-CH(CH_3)_2$ | $-Cl$ | 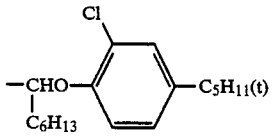 |
| C-49 | $-C_2H_5$ | $-Cl$ | 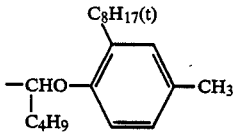 |
| C-50 | $-C_2H_5$ | $-Cl$ | 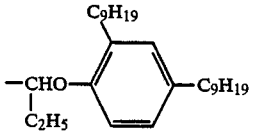 |
| C-51 | $-C_4H_9$ | $-OCH_2CH_2-SO_2CH_3$ | 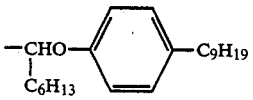 |
| C-52 | $-C_2H_5$ | $-Cl$ | 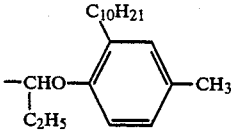 |

-continued

General Formula [IV]

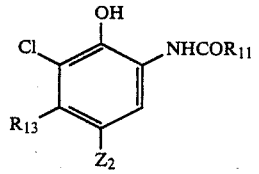

| Coupler No. | $R_{13}$ | $Z_2$ | $R_{11}$ |
|---|---|---|---|
| C-53 | $-C_4H_9$ | 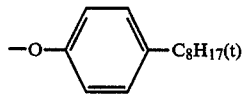 | 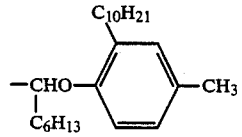 |
| C-54 | $-C_2H_5$ | $-Cl$ | 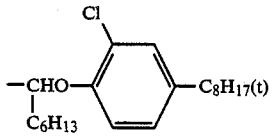 |
| C-55 | $-C_2H_5$ | $-OCH_2CH_2SCH(C_2H_5)COOH$ | 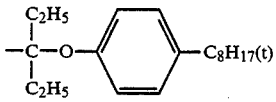 |
| C-56 | $-C_2H_5$ | $-Cl$ | 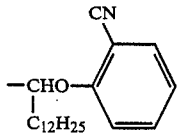 |
| C-57 | $-C_2H_5$ | $-Cl$ | 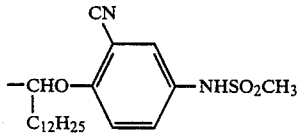 |
| C-58 | $-C_2H_5$ | $-Cl$ | 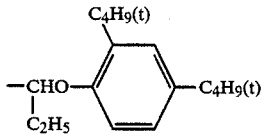 |
| C-59 | $-C_2H_5$ | $-Cl$ | 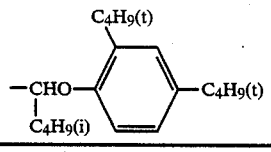 |

The example of cyan coupler expressed by Formula [IV] include those phenol cyan couplers, having an alkyl group with two or more carbon atoms in the 5-position, described in Japanese O.P.I. Publications Nos. 37425/1972, 10135/1975, 25228/1975, 112038/1975, 117422/1975, 130441/1975, U.S. Pat. Nos. 2,369,928, 2,423,730, 2,434,272, 2,474,293, 2,698,794, 2,895,826, Japanese O.P.I. Publications Nos. 112038/1975, 109630/1978, 163537/1980, U.S. Pat. Nos. 3,772,002 and 4,443,536, all of which disclosing the methods according to which the cyan coupler may be easily synthesized.

In the present invention, at least one type, and preferably both types, of the cyan couplers of the invention represented by Formula [III] and [IV], are used.

The cyan coupler of the invention is incorporated into the red-sensitive silver halide emulsion layer. The amount of addition is $2\times10^{-3}-8\times10^{-1}$ mol, and preferably $1\times10^{-2}$ to $5\times10^{-1}$ mol per mol silver halide.

As is described above, the cyan coupler of the invention, together with the non-color forming compound of the invention and the high boiling organic solvent also of the invention, is contained in the red-sensitive silver halide emulsion layer of the silver halide photographic light-sensitive material of the invention, and in which case, the cyan coupler and the non-color forming compound should be preferably contained in the same hydrophobic organic phase (such as an oil phase) of the red-sensitive silver halide emulsion layer.

More specifically, it is preferable to dissolve simultaneously the cyan coupler of the invention and the non-color forming compound of the invention to the high boiling organic solvent of the invention, with another high boiling organic solvent or possibly with a low boiling and/or water-soluble organic solvent, as needed, and the solution to an object red-sensitive silver halide emulsion layer, after dispersing it by emulsification in a hydrophilic binder, such as, in an aqueous gelatin solution, by using a surface active agent. In some cases, the non-color forming compound of the invention itself is employed as a high boiling organic solvent.

Apart from the high boiling organic solvent of the invention, the examples of preferred solvents which are used according to a specific requirement include an organic solvent with a boiling point of 150° C. or above, such as, a phenol derivative, phthalic ester, citric ester, benzoic ester, alkylamide, fatty acid ester and trimesic ester, each of which does not react with an oxidized product of a developing agent.

The examples of low boiling organic solvent which may be employed according to a specific requirement include ethyl acetate, cyclohexanol, methylethylketone, etc.

For an additional increase in the maximum density of the cyan dye image, it is preferable for the red-sensitive silver halide emulsion layer of the silver halide photographic light-sensitive material of the invention to contain silver halide grains having not less 90 mol % silver chloride content (hereinafter referred to as "the silver halide grains of the invention").

The preferred silver halide grains of the invention are those which have a silver chloride content of not less than 90 mol %, silver bromide content of not more than 10 mol % and silver iodide content of not more than 0.5 mol %, and in particular, silver chrolo-bromide having a silver bromide content of 0.1 to 5 mol %.

The silver halide grains of the invention may be used either independently or by mixing them with another type of silver halide grains of a different composition. Moreover, the silver halide grains of the invention may be mixed with silver halide grains having a silver chloride content of not more 10 mol %.

Furthermore, in the case of a silver halide emulsion layer of the invention which contains silver halide grains with a silver chloride content of not less than 90 mol %, the amount of the same silver halide grain against the entire silver halide content of the emulsion layer is not less than 60 and preferably 80 weight %.

Usually, in the silver halide photographic light-sensitive material, including a color photographic paper, the silver halide emulsion layers respectively having magenta, yellow and cyan couplers as photographic couplers as well as a non-light sensitive layers, for the purpose of color reproduction by color reduction method, are structurally disposed on the support in an appropriate number and order which may be modified depending on a specific purpose and requirement.

A specific example of a preferred layer structure of the silver halide photographic light-sensitive material employed in the invention is that, starting from the support, a yellow dye image forming layer, intermediate layer, magenta dye image forming layer, intermediate layer, cyan dye image forming layer, and intermidiate layer and a protection layer, all of which are disposed on the support in an order just provided.

An acylacetanilide coupler is preferred for use as a yellow coupler in the invention; a benzoyl acetanilide compound and pyvaloyl acetanilide compound, in particular, are useful for this purpose.

In the invention, the known 5-pyrazolon coupler, pyrazoltriazole coupler and other pyrazoloazole couplers are preferred as a magenta coupler.

As long as it does not jeopardize the objects of the invention, the cyan coupler of the invention may be used in combination with another conventionally known cyan coupler.

The silver halide emulsion employed in the invention is chemically sensitized by conventional methods, such as, a sulphur synthesizing method using active gelatin or a compound containing sulphur that is capable of reacting with silver ion; a selenium sensitizing method using a selenium compound; a reduction sensitizing method using a reducting substance; or a noble metal sensitizing method using gold or another noble metal. All of such methods listed above may be applied either independently or in combination with another method.

The silver halide used in the invention may be optically sensitized by adding a sensitizing dye which appropriately serves to provide sensitivity to a desired range of sensitive wave length.

Following agents may be arbitrarily incorporated into the silver halide photographic light-sensitive material of the invention: an anti-color fogging agent, dye-image stabilizer, hardener, plasticizer, polymer latex, ultraviolet absorbent, formalin scavenger, dye mordant, development accelerator, development retarder, fluorescent whitening agent, matting agent, lubricant, antistatic agent, surface active agent, etc.

Various types of color development are available for the development of silver halide photographic light-sensitive material of the invention.

The silver halide photographic light-sensitive material is applicable to color negative and color positive films, as well as to negative-positive type and positive type color photographic papers.

The silver halide photographic light-sensitive material of the invention excels in color reproducibility because its maximum absorption wave length of the cyan dye image is located in the long wave side, which secondary absorption is kept small in the vicinity of 420 nm and 550 nm.

Furthermore, the silver halide photographic light-sensitive material of the invention has excellent cyan dye image preservability.

In addition, the color density is sufficiently high with the silver halide photographic light-sensitive material of the invention.

EXAMPLES

The examples embodying the invention are provided below. This however, does not mean that the scope of embodiment of the invention is limited to those examples presented below.

EXAMPLE 1

(Preparation of silver halide emulsion)

Four types of silver halide emulsions presented in Table-1 were prepared by the neutral process and double-jet precipitation method.

TABLE 1

| Emulsion No. | Ag Cl % | Ag Br % | Average grain size μm | Chemical sensitizer | Spectral sensitizing dye |
|---|---|---|---|---|---|
| Em-1 | 99.5 | 0.5 | 0.67 | Sodium thiosulfate | SD-1 *3 |
| Em-2 | 99.5 | 0.5 | 0.46 | Sodium *1 | SD-2 *4 |
| Em-3 | 99.5 | 0.5 | 0.43 | Chloroauric acid *2 Sodium thiosulfate | SD-3 *5 |
| Em-4 | 30 | 70 | 0.43 | Sodium *1 | SD-3 *5 |

*1: 2 mg added per mol silver halide
*2: $5 \times 10^{-5}$ mol added per mol silver halide
*3: 0.9 milimol added per mol silver halide
*4: 0.7 milimol added per mol silver halide
*5: 0.2 milimol added per mol silver halide After completion of chemical sensitization, to each silver halide emulsion was added, as a stabilizer, STB-1 indicated below, at a ratio of $5 \times 10^{-3}$ mol per mol silver halide.

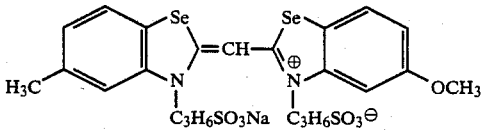

SD-1

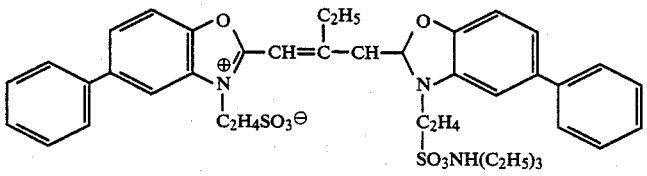

SD-3

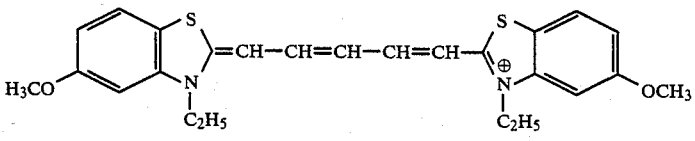

STB-1

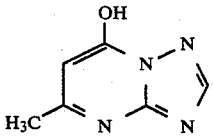

Preparation of silver halide color photographic light-sensitive material samples Silver halide photographic light-sensitive materials Nos. 1 through 38 were prepared by forming (simultaneously), in a specific layer order, layers 1 through 7 described below, on a paper support both of whose surfaces are coated with polyethylene. The amount in the following examples are amounts per one $m^2$, light sensitive material.

Layer 1

A layer containing gelatin (1.2 g) and 0.29 g (a converted value representing silver, the same shall apply hereinafter) of blue-sensitive silver halide emulsion (Em-1), and 0.3 g of dinonylphtalate (DNP) in which 0.75 g of yellow coupler (Y-1), 0.3 g of light stabilizer ST-1 and 0.015 g of 2,5-dioctylhydroquinone (HQ-1) having been dissolved.

Layer 2

A layer containing gelatin (0.9 g), and 0.2 g of DOP (dioctylphothalate) in which 0.04 g of HQ-1 having been dissolved.

Layer 3

A layer containing gelatin (1.4 g) and 0.2 g of green-sensitive halide emulsion (Em-1), and 0.03 g of DOP in which 0.50 g of magenta coupler (M-1), 0.25 g of light stabilizer ST-2 and 0.01 g of HQ-1 having been dissolved, as well as 6 mg of filter dye AI-1 below.

LAYER 4

A layer containing gelatin (1.2 g), and 0.3 g of DNP in which 0.6 g of ultraviolet absorbent UV-1 and 0.05 g of HG-1 having been dissolved Layer 5

A layer containing gelatin (1.4 g), 0.20 g of red-sensitive silver halide emulsion (Em-3), and 0.3 g of HBS indicated in Table-2 in which 0.9 milimol of cyan coupler indicated in Table-2, 0.3 g of non-color forming compound of the invention indicated in Table-2, 0.01 g of HQ-1 and 0.3 g of ST-1 having been dissolved Layer 6

A layer containing gelatin (1.1 g), and 0.2 g of DOP into which 0.2 g of UV-1 having been dissolved, as well as 5 mg of filter dye AI-2 indicated below Layer 7

A layer containing gelatin (1.0 g) and 0.05 g of sodium 2,4-dichloro-6-hydroxytriazine.

In the above examples, HBS means either a comparison high boiling organic solvent or the high boiling point organic solvent of the invention.

ST-1

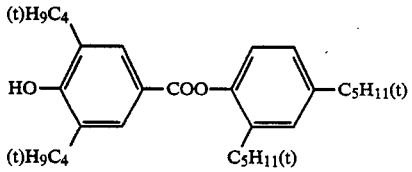

ST-2

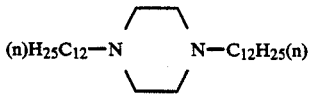

UV-1

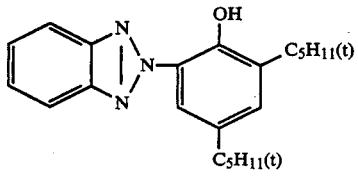

AI-1

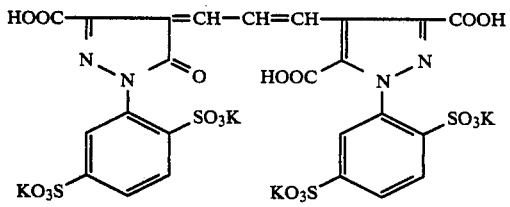

AI-2

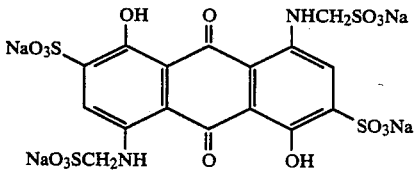

Y-1

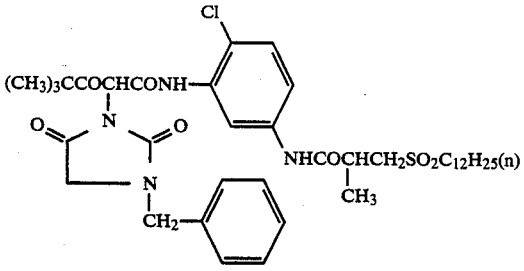

M-1

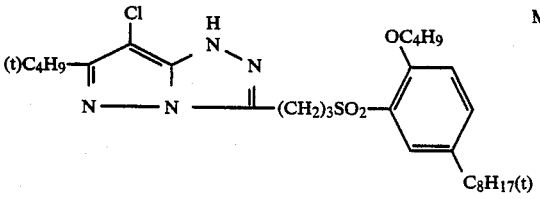

Silver halide color photographic light-sensitive materials Nos. 39 through 42 were also prepared in a manner identical with the above description, except for substituting the red-sensitive silver halide emulsion of layer 5 above with Em-4 indicated in Table-1.

After exposure with an optical wedge using a sensitometer KS-7 (manufactured by Konica Corporation), the obtained samples were processed by a color developing process presented below, and then their maximum density (Dmax) in the red-sensitive emulsion layer was mesured using an optical densitometer (Model PDA-65, manufactured by Konica Corporation)

Furthermore, the maximum absorption length (max) as well as the density at 420 nm and 550 nm ($D_B$ and $D_G$) were measured under the assumption that the density of a cyan dye image is 1.0.

In addition, after storing the samples for 20 days in a place where the temperature is 85° C. with a relative humidity of 60%, the dye-image residual rate (%) was measured against an initial density of 1.0 so as to assess the dark fading property.

The results are listed in Table-2.

| [Processing Steps] | Temperature | Time |
|---|---|---|
| Color developing | 34.7 ± 0.3° C. | 45 sec. |
| Bleach-fixing | 34.7 ± 0.5° C. | 50 sec. |
| Stabilizing | 30–34° C. | 90 sec. |
| Drying | 60–80° C. | 60 sec. |
| [Color Developer] | | |
| Pure water | | 800 ml |
| Triethanolamine | | 8 g |
| N,N—diethylhydroxylamine | | 5 g |
| Potassium chloride | | 2 g |
| N—ethyl-N—β-methanesulfomamidoethyl-3-methyl-4-aminoaniline sulfate | | 5 g |
| Sodium tetrapolyphosphate | | 2 g |
| Potassium carbonate | | 30 g |
| Potassium sulfite | | 0.2 g |
| Fluorescent whitening agent (4'4-diaminostylbenzisulfonic derivative) | | 1 g |
| Water was added to make one liter solution, which was arranged to have the pH of 10.2. | | |
| [Bleach-fixer] | | |
| Ferric ammonium ethylenediaminetetraacetate dihydrate | | 60 g |
| Ethylenediaminetetraacetic acid | | 3 g |
| Ammonium thiosulfate (70% solution) | | 100 g |
| Ammonium sulfite (40% solution) | | 27.5 g |
| Potassium carbonate or glacial acetic acid was added so as to attain the pH value of 5.5, whereby water was added in order to prepare one liter solution. | | |
| [Stabilizing solution] | | |
| 5-chloro-2-methyl-4-isothiazoline-3-one | | 1 g |
| 1-hydroxyethylidene-1,1-diphosphonic acid | | 2 g |

Water was added to make one liter solution, which was treated with sulfuric acid or potassium hydroxide to have the pH value of 7.0.

CC-1

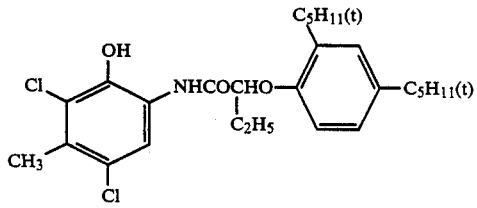

HBS-1

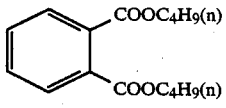

TABLE 2

| Sample No. | Cyan coupler | Non-color forming compound of the invention | HBS | Maximum density Dmax | Maximum absorption wave length λmax [nm] | $D_G$ | $D_B$ | Dark fading property | Note |
|---|---|---|---|---|---|---|---|---|---|
| 1 | CC-1 | — | HBS-1 | 2.78 | 652 | 0.472 | 0.436 | 21 | Comparative example |
| 2 | C-2 | — | HBS-1 | 2.29 | 649 | 0.513 | 0.363 | 96 | Comparative example |
| 3 | C-18 | — | HBS-1 | 2.18 | 648 | 0.510 | 0.360 | 95 | Comparative example |
| 4 | C-23 | — | HBS-1 | 2.36 | 649 | 0.514 | 0.364 | 96 | Comparative example |
| 5 | C-24 | — | HSB-1 | 2.42 | 648 | 0.516 | 0.362 | 94 | Comparative example |
| 6 | C-29 | — | HBS-1 | 2.57 | 655 | 0.468 | 0.448 | 54 | Comparative example |
| 7 | C-30 | — | HBS-1 | 2.54 | 656 | 0.470 | 0.445 | 63 | Comparative example |
| 8 | C-2 | — | II-7 | 2.09 | 647 | 0.522 | 0.372 | 98 | Comparative example |
| 9 | C-18 | — | II-7 | 2.04 | 646 | 0.519 | 0.370 | 99 | Comparative example |
| 10 | C-23 | — | II-7 | 2.01 | 647 | 0.524 | 0.374 | 99 | Comparative example |
| 11 | C-24 | — | II-7 | 2.18 | 646 | 0.525 | 0.371 | 98 | Comparative example |
| 12 | C-29 | — | II-7 | 2.28 | 652 | 0.475 | 0.460 | 78 | Comparative example |
| 13 | C-30 | — | II-7 | 2.25 | 652 | 0.479 | 0.457 | 81 | Comparative example |
| 14 | CC-1 | A-32 | II-7 | 2.88 | 654 | 0.463 | 0.437 | 41 | Comparative example |
| 15 | C-2 | A-32 | II-7 | 2.53 | 653 | 0.473 | 0.362 | 98 | Present invention |
| 16 | C-18 | A-32 | II-7 | 2.50 | 653 | 0.470 | 0.360 | 99 | Present invention |
| 17 | C-23 | A-32 | II-7 | 2.62 | 652 | 0.475 | 0.363 | 99 | Present invention |
| 18 | C-24 | A-32 | II-7 | 2.70 | 652 | 0.474 | 0.361 | 99 | Present invention |
| 19 | C-29 | A-32 | II-7 | 2.72 | 656 | 0.438 | 0.442 | 82 | Present invention |
| 20 | C-30 | A-32 | II-7 | 2.74 | 657 | 0.441 | 0.440 | 83 | Present invention |
| 21 | C-2 | A-2 | II-7 | 2.57 | 653 | 0.468 | 0.362 | 99 | Present invention |
| 22 | C-2 | A-15 | II-7 | 2.60 | 653 | 0.472 | 0.364 | 98 | Present invention |
| 23 | C-2 | A-30 | II-7 | 2.58 | 652 | 0.471 | 0.362 | 99 | Present invention |
| 24 | C-2 | A-38 | II-7 | 2.57 | 654 | 0.469 | 0.363 | 99 | Present invention |
| 25 | C-2 | A-50 | II-7 | 2.54 | 653 | 0.472 | 0.363 | 99 | Present invention |
| 26 | C-2 | A-62 | II-7 | 2.61 | 654 | 0.470 | 0.363 | 98 | Present invention |
| 27 | C-2 | A-79 | II-7 | 2.59 | 654 | 0.468 | 0.362 | 98 | Present invention |
| 28 | C-2 | A-92 | II-7 | 2.63 | 654 | 0.469 | 0.364 | 99 | Present invention |
| 29 | C-2 | A-100 | II-7 | 2.64 | 656 | 0.465 | 0.361 | 99 | Present invention |
| 30 | C-2 | A-118 | II-7 | 2.63 | 656 | 0.464 | 0.363 | 98 | Present invention |
| 31 | C-2 | A-32 | II-1 | 2.54 | 653 | 0.468 | 0.364 | 99 | Present invention |
| 32 | C-2 | A-32 | II-4 | 2.62 | 653 | 0.471 | 0.366 | 98 | Present invention |
| 33 | C-2 | A-32 | II-6 | 2.60 | 652 | 0.470 | 0.365 | 98 | Present invention |
| 34 | C-2 | A-32 | II-10 | 2.53 | 653 | 0.470 | 0.363 | 99 | Present invention |
| 35 | C-2 | A-32 | II-15 | 2.58 | 654 | 0.471 | 0.363 | 99 | Present invention |
| 36 | C-2 | A-32 | II-21 | 2.57 | 653 | 0.467 | 0.367 | 99 | Present invention |
| 37 | C-2 + C-29 | A-32 | II-7 | 2.80 | 653 | 0.465 | 0.402 | 94 | Present invention |
| 38 | C-2 + C-30 | A-32 | II-4 | 2.78 | 653 | 0.463 | 0.397 | 95 | Present invention |
| 39 | C-2 | — | HBS-1 | 1.58 | 650 | 0.503 | 0.370 | 96 | Comparative |

TABLE 2-continued

| Sample No. | Cyan coupler | Non-color forming compound of the invention | HBS | Maximum density Dmax | Maximum absorption wave length λmax [nm] | $D_G$ | $D_B$ | Dark fading property | Note |
|---|---|---|---|---|---|---|---|---|---|
| 40 | C-2 | — | II-7 | 1.37 | 647 | 0.520 | 0.372 | 99 | example Comparative example |
| 41 | C-2 | A-32 | II-7 | 1.98 | 653 | 0.475 | 0.361 | 99 | Present invention |
| 42 | C-2 | A-32 | II-4 | 2.04 | 653 | 0.478 | 0.363 | 99 | Present invention |

As it is evident from the results presented in Table 2, while sample No. 1 in which a conventionally used cyan coupler CC-1 was dissolved and dispersed in a conventional high boiling point solvent, has a high Dmax value, a long was λmax and small $D_G$, its poor dark fading property makes it unsuitable for practical application.

In contrast, although samples Nos. 2 through 5 in which the cyan coupler expressed by General Formula [III] of the invention was dissolved and dispersed in a conventional high boiling organic solvent, demonstrates a significant improvement in the dark fading property, since their λmax is found on the short wave side and their $D_G$ value is very low, green color was not reproduced to a sufficient degree. Furthermore, in the case of samples Nos. 6 and 7 in which the cyan coupler expressed by General Formula [IV] of the invention was dissolved and dispersed in a conventional high boiling organic solvent, while Dmax is high and excellent color reproducibility (λmax, $D_G$ and $D_B$) realized, their dark fading property is short of reaching a satisfactory level.

On the other hand, with samples Nos. 8 through 13 in which the high boiling organic solvent of the invention was employed, although there is a significant increase in the dark fading property, there also is an obvious lowering of Dmax value, transformation of λmax into a short wave and an increase in the $D_G$ value, all of which resulted in a deterioration of color reproducibility.

In comparison to all of the samples listed so far, samples Nos. 15 through 36, in which the cyan coupler or the invention, the high boiling organic solvent of the invention and the non-color forming compound invention employed, indicated a high Dmax, long wave λmax as well as sufficiently small $D_G$ and $D_B$ values, which demonstrate the fact that they are of particularly high quality silver halide photographic light-sensitive material with excellent color reproducibility and superior dark fading property.

Furthermore, with samples Nos. 37 and 38 where the cyan couplers of the invention respectively expressed by Formula [III] and [IV] as well as the non-color forming compound of the invention and high boiling organic solvent of the invention were simultaneously sued, Dmax is even higher, λmax is a long wave and $D_G$ and $D_B$ are small, which demonstrates excellent color reproducibility of green and blue colors as well as superior dark fading property capable of sufficiently satisfying the requirements.

Also, in the case of samples Nos. 41 and 42 where silver halide with a relatively low silver chloride content, although their color forming property (Dmax) is still unsatisfactory, there is a significant improvement in their color forming property (Dmax) as well as their color reproducibility (λmax, $D_G$ and $D_B$) when compared to samples Nos. 38 and 39 not in compliance with the invention. In essence, the advantage of the invention is apparent.

What is claimed is:

1. A silver halide photographic light-sensitive material comprising a support having thereon a blue-sensitive silver halide emulsion layer, a green-sensitive silver halide emulsion layer and a red-sensitive silver halide emulsion layer, wherein said red-sensitive silver halide emulsion layer contains a non-color-forming compound represented by the following Formula [I], a compound represented by the following Formula [II] and at least one cyan coupler represented by the following Formula [III] or [IV]:

$$R_1—NHSO_2—R_2 \qquad \text{Formula[I]}$$

wherein $R_1$ is a group represented by the following Formula $I_a$ and $R_2$ is an alkyl group, an aryl group or a dialklamino group, which is allowed to have a substituent;

Formula [$I_a$]

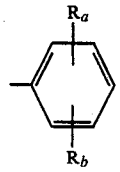

wherein $R_a$ and $R_b$ are individually hydrogen, halogen, alkyl, nitro, alkoxyl, cyano, dialylamino, acyl or alkoxylcarbonyl;

Formula [II]

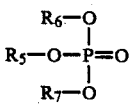

wherein $R_5$, $R_6$ and $R_7$ are individually an alkyl group, a cycloalkyl group or an aryl group, and each group represented by $R_5$ through $R_7$ is allowed to have a substituent;

Formula [III]

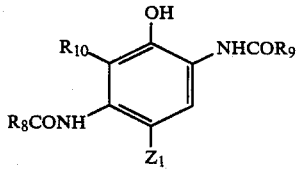

wherein $R_8$ is an alkyl group or an aryl group; $R_9$ is an alkyl group, a cycloalkyl group, an aryl group or a heterocyclic group; $R_{10}$ is a hydrogen atom, a halogen atom, an alkyl group or an alkoxy group, and $R_{10}$ is allowed to bond with $R_8$ to form a ring; $Z_1$ is a hydrogen atom or a group capable of being released upon reaction with the oxidized product of an aromatic primary amine color developing agent; and each group represented by $R_8$ through $R_{10}$ is allowed to have a substituent;

Formula [IV]

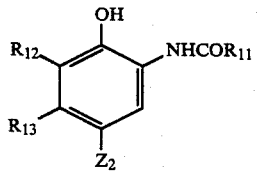

wherein $R_{11}$ is a ballast group: $R_{12}$ is a hydrogen atom, a halogen atom or an alkyl group; $R_{13}$ is an alkyl group having two to six carbon atoms; $Z_2$ is a hydrogen atom or a group capable of being released upon reaction with the oxidized product of an aromatic primary amine color developing agent; and each group represented by $R_{11}$ through $R_{13}$ is allowed to have a substituent.

2. The silver halide photographic light-sensitive material of claim 1, wherein the number of carbon atoms contained in the compound represented by the formula [I] is not less than eight.

3. The silver halide photographic light-sensitive material of claim 1, wherein the number of carbon atoms contained in the compound represented by the formula [I] is not less than twelve.

4. The silver halide photographic light-sensitive material of claim 1, wherein said $R_5$, $R_6$ and $R_7$ of the formula [II] are an alkyl group, respectively.

5. The silver halide photographic light-sensitive material of claim 1, wherein said $R_5$, $R_6$ and $R_7$ of the formula [II] are an alkyl group having six to twelve carbon atoms, respectively.

6. The silver halide photographic light-sensitive material of claim 1, wherein said $R_8$ of the formula [III] is an alkyl group which is allowed to have a substituent.

7. The silver halide photographic light-sensitive material of claim 1, wherein said $R_9$ of the formula [III] is an aryl group which is allowed to have a substituent.

8. The silver halide photographic light-sensitive material of claim 1, wherein said $R_{10}$ is a hydrogen atom.

9. The silver halide photographic light-sensitive material of claim 1, wherein $R_{12}$, of the formula [IV] is a chlorine atom.

10. The silver halide photographic light-sensitive material of claim 1, wherein said $R_{13}$ of the formula is ethyl group.

11. The silver halide photographic light-sensitive material of claim 1, wherein said $Z_2$, of the formula [IV] is a chlorine atom.

12. The silver halide photographic light-sensitive material of claim 1, wherein an amount of said cyan-forming coupler represented by the formula [III] or [IV] contained in said red-sensitive silver halide emulsion layer is within the range of from $2\times10^{-3}$ to $8\times10^{-1}$ mole per mol of silver halide contained said red-sensitive emulsion layer.

13. The silver halide photographic light-sensitive material of claim 1, wherein an amount of said cyan-forming coupler represented by the formula [III] or [IV] contained in said red-sensitive silver halide emulsion layer is within the range of from $1\times10^{-2}$, to $5\times10^{-1}$ mole per mol of silver halide contained said red-sensitive emulsion layer.

14. The silver halide photographic light-sensitive material of claim 1, wherein an amount of said non-color forming compound represented by the formula [I] contained in said red-sensitive silver halide emulsion layer is within the range of from 5 to 500 mol % to the total amount of said cyan-forming coupler represented the formula [III] or [IV] contained in said red-sensitive emulsion layer.

15. The silver halide photographic light-sensitive material of claim 1, wherein an amount of said non-color forming compound represented by the formula [I] contained in said red-sensitive silver halide emulsion layer is within the range of from 10 to 300 mol % to the total amount of said cyan-forming coupler represented the formula [III] or [IV] contained in said red-sensitive emulsion layer.

16. The silver halide photographic light-sensitive material of claim 1, wherein an amount of said compound represented by the formula [II] contained in said red sensitive silver halide emulsion layer is within the range of from 10 to 500 g per 100 g of said cyan-forming coupler represented by the formula [III] or [IV] contained in said red-sensitive emulsion layer.

17. The silver halide photographic light-sensitive material of claim 1, wherein silver halide grains contained in said red-sensitive silver halide emulsion layer comprises not less than 90 mol % of silver chloride.

18. The silver halide photographic light-sensitive material of claim 1, wherein silver halide grains contained said red-sensitive emulsion layer comprises silver chlorobromide containing 0.1 to 5 mol % of silver bromide.

19. The silver halide photographic light-sensitive material of claim 1 wherein said $R_2$ is an aryl group, which may have a substituent.

20. The silver halide photographic light-sensitive material of claim 1 wherein said $R_2$ is a phenyl group which may have a substituent.

* * * * *